United States Patent [19]

Amuchastegui

[11] 4,132,173

[45] Jan. 2, 1979

[54] CARTRIDGE CASE ASSEMBLY

[75] Inventor: Francisco Amuchastegui, San Sebastian, Spain

[73] Assignee: Ziger, S.A., Vitoria, Spain

[21] Appl. No.: 794,687

[22] Filed: May 6, 1977

[30] Foreign Application Priority Data

May 8, 1976 [ES] Spain ..... 220.820

[51] Int. Cl.[2] ..... F42B 7/06

[52] U.S. Cl. ..... 102/44; 102/43 P; 102/45

[58] Field of Search ..... 102/38 R, 42 R, 43 P, 102/44, 45, 95

[56] References Cited

U.S. PATENT DOCUMENTS

| | | | |
|---|---|---|---|
| 695,996 | 3/1902 | Bailey | 102/44 |
| 3,139,030 | 6/1964 | Yamamoto | 102/45 |
| 3,292,541 | 12/1966 | Stadler et al. | 102/44 X |
| 3,516,357 | 6/1970 | Hendricks | 102/45 |
| 3,688,699 | 9/1972 | Horn et al. | 102/43 P |
| 3,732,820 | 5/1973 | Hendricks | 102/45 |
| 4,020,763 | 5/1977 | Iruretagoyena | 102/44 |

FOREIGN PATENT DOCUMENTS

| | | | |
|---|---|---|---|
| 1082044 | 6/1954 | France | 102/43 P |
| 1110473 | 10/1955 | France | 102/43 P |

*Primary Examiner*—Verlin R. Pendegrass
*Attorney, Agent, or Firm*—Karl W. Flocks

[57] ABSTRACT

A cartridge case assembly of the type constituted by internal wad, external extruded tube and intermediate body or welding mass, so characterized because the wad provides a house or cylindrical cavity hollow at the head side, in which a base element includes a promontory in peak form extending toward the head from a longitudinal shaft portion on which the fulminate rests, all gathered by the intermediate welding mass that fusion-weld the case with the wad, embracing the latter in such a way that the fulminate is included within it, forming an integrating monobloc of case, wad and fulminate, so that within the space of the fulminate housing appropriate weight and gas communication between the container chambers of the gun-powder adjacent to wad are provided.

5 Claims, 7 Drawing Figures

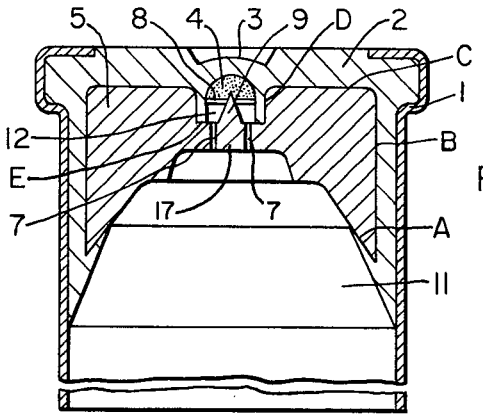
FIG. 1.
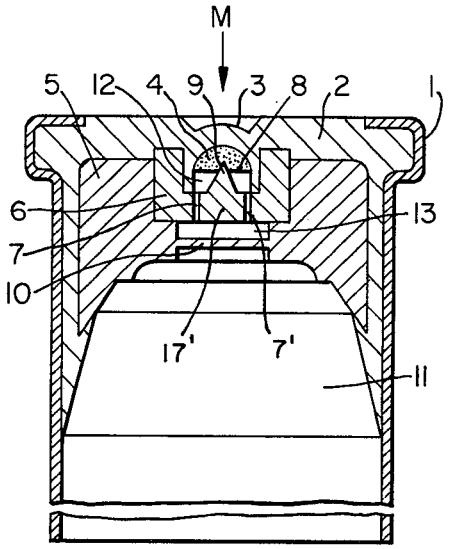
FIG. 2.
FIG. 3.
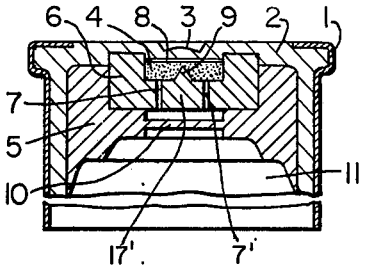
FIG. 4.
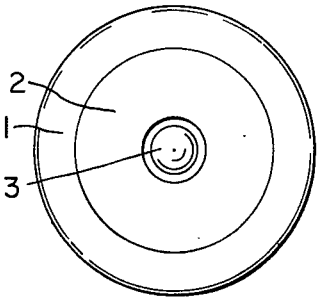

CARTRIDGE CASE ASSEMBLY

BACKGROUND OF THE INVENTION

1. Field of the Invention

The field of the invention embraces the cartridge case assembly construction art as exemplified by art which would be found in Class 102/43 and related subclasses indented thereunder.

2. Description of the Prior Art

The technique used in manufacturing the cartridge defined in U.S. Pat. No. 4,020,763 may be used to manufacture the cartridge case according to the present invention with such cartridge case being formed of plastic on the basis of three basic bodies, precisely assembled among themselves so as to constitute a monobloc assembly. In view of the foregoing the objects of this application may be considered comparible to those stated in said U.S. Pat. No. 4,020,763.

It is known that a conventional cartridge is constituted by three known elements, namely:

A. Case or external container element.

B. Piston or fulminate holder to make the shot.

C. Explosive charge, with its wad, gun-powder, hail-shot, etc.

The case, contains the piston and all the explosive charge in such a way that the action against the piston from the external part is transmitted to the gun-powder, which explodes such components, projecting outside the entire load contained inside.

The piston is introduced in the case, through a central opening, formed in the head of the said case, while the explosive charge is introduced in the opposite end, closing the case opening.

SUMMARY OF THE INVENTION

The present invention has for an object the constitution of a case for cartridges that avoids not only the well-known type piston but the subsequent operation that consists in its internal introduction and positioning.

Another object of the invention is to provide a cartridge case assembly that forms a monobloc assembly and that includes the fulminate and own means to initiate ignition to subsequently effect the gun-powder explosion.

It is another object of the invention to make a case of the type above mentioned in which there is an opening in the head that communicates with the outer part while it is full-close to the outer part.

It is another object of the invention to provide a percussion cone that is constitutive of the wad of which it is a part of an auxiliary piece housed inside the case, though fully insulated from the outer part and at the same time embraced by its entire external contour, forming a monobloc.

BRIEF DESCRIPTION OF THE DRAWINGS

The base purposes of the invention will become graphically clear as illustrated in the accompanying drawings, in which:

FIG. 1 is a sectional elevation of a case of the type made in accordance with the present invention;

FIG. 2 is a sectional elevational view of an alternative embodiment according to the present invention;

FIG. 3 shows a sectional elevational view of still another embodiment to facilitate inspection of the shape or location of the different elements in still another embodiment of the present invention;

FIG. 4 is a plan view showing the head zone of the case according to the present invention;

DETAILED DESCRIPTION OF THE INVENTION

Figure 5:
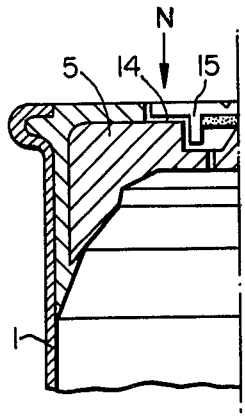
FIG. 5 shows yet another embodiment within the basic inventive concept.

Referring in detail to the drawings, the reader should appreciate that with regard to FIG. 1 that according to what is described in U.S. Pat. No. 4,020,763 the cartridge case comprises three basic elements, namely:

(1) External extrusioned tube.

(2) Wad.

(3) Intermediate zone or welding mass, elements that properly combinated constitute a monobloc assembly.

The novel subject matter described herein resides in making in wads a hollow cylindrical chamber or entrance 12, in which the position of a longitudinal shaft 17 having base or bottom with a rim or promontory 9 extending therefrom constituting a peak zone 9 that is defined by the case head side, appearing in FIG. 4 as the upper front face.

Above the promontory 9 is disposed the fulminate supported with or without paper 8 perfectly centered in relation with the cartridge longitudinal shaft.

By its part, the intermediate body or welding mass 2 that connects and links the extruded tube 1 and wad 5 embraces the latter, covering:

part of its internal-lower surface A.

all the surface of its external side walls B.

the entire surface of its upper face C.

the entire surface of the side walls of the case or cylindrical central hollow sleeve portion D.

part of the surface of the base of bottom of the cylindrical cavity E.

All together fully embracing the fulminate, forming a monobloc, the case and wad 5, in which internal part the fulminate remains perfectly integrated and fully-closed.

The welding mass or intermediate body 2, is enclosed to a certain extent from entry sides of chamber 11 to its own base, which encircles the base of the promontory 9 whereby adjustment and physical union of mass 2 and wad 5 is made, and so increasing.

On the other side, the base or bottom of the cylindrical entrance or chamber 12 are provided some conduits 7 in wad 5 that communicate between the said chamber 12 that of the case internal part 11 in which the gun-powder is housed and which main purpose is that of allowing the passage of the gases that will come from the fulminate until exploding this gun-powder.

It must be noted that these conduits 7, can be replaced by a very thin plate portion 10, constituted by the wad 5 itself or by another type of similar means that allow the passage of the gases towards the chamber 11, either simply by the opened conduit 7 or by weakened zone 10. Where the conduits 7 are replaced by a thin plate portion 10, an auxiliary piece 6 with conduits 7' around a longitudinal shaft 17', as illustrated in FIGS. 2 and 3, may be provided between the wad 5 and the welding mass 2.

By its part, the head provides in its central zone, a reduced portion 3, which facilitates adjustment, if necessary, the adequate distance between its external surface and the fulminant location zone, thus, the wall thickness, so to conveniently effect ignition of the fulminate by the firing pin.

With the above features in mind applicant notes that the present invention provides for the function of controlling at own request the said distance.

The embodiment illustrated in FIG. 2 relates to an operating variant without prejudging the existence of new material, as there are identical characteristics, except in this particular case, the promontory 9 is made on an auxiliary member 6' mentioned above, which is perfectly gathered and embraced by the wad 5 and the intermediate body or welding mass 2.

In this embodiment, the wad internal part 5 presents a weakened zone 10 which together with the conduits 7' in auxiliary piece 6 will readily provide communication from chamber 13 through a gas outlet towards the chamber 11 of the case.

Equally, the welding mass 2 is housed in the chamber 12, in identical conditions to that reflected in FIG. 1 adopting one or other embodiment, as the concrete application of the case.

Another constructive variation according to the invention appears in FIG. 3 in which there is a small difference which is that the fulminant 4 occupies the lowest section of the chamber 12, arranging the separating paper 8 above it.

On the other hand, firing operation of the disclosed cartridge assembly will be initiated by means of a firing pin or needle, as per head M, acting directly on the intermediate body or welding mass 2, from which the fulminate chamber 12 will communicate with chamber 11 and effect explosion of gun powder located in the latter chamber. In any event, even under the hardest conditions, the fulminate gases can't go through the head zone.

The basic idea of the invention is in the realization within the wad and duly centering of a chamber with a promontory of adequate hardness, fully-closed, either at its lower part, except for the conduits in its case of communications, as for its sides and upper zone, in a way that it constitutes a fully-tight unit and of the convenient resistance to support the action and reaction of the gases which come from the fulminate explosion. Within this very same concept and it is important to note that the steps are formed of the conduits that are conveniently located between the chamber in which the fulminate is housed and the chamber in which the gunpowder is housed and other cartridge elements.

In one or the other case the invention combines by one side the resistance, either of the promontory on which the fulminate explosion is made or the resistance of the external covering front of the cartridge.

Figure 6:
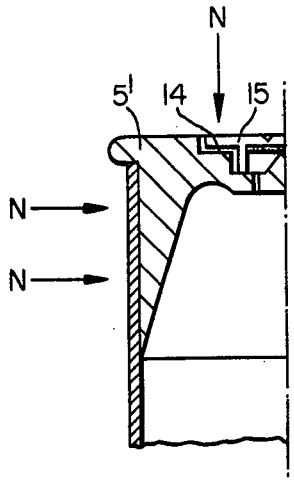
FIG. 6 is still another embodiment within general concept of the present invention.
Figure 7:
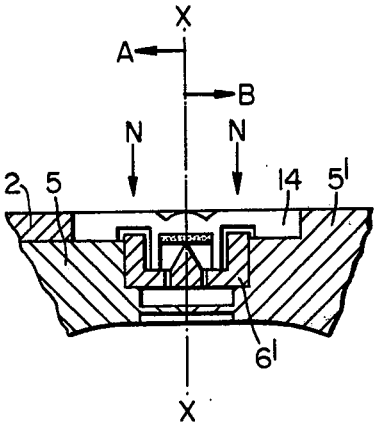
FIG. 7. This figure finally allows us to see different constructive alternatives.

In this sense, there are also disclosed embodiments illustrated in the FIGS. 5, 6 and 7 in which there is noted the possibility of adopting other techniques which lead to the same objective.

Looking at the embodiments of the FIG. 5, it can be readily seen that the cover 15 acts as a holder of the fulminate, which is arranged frontally in the base and connected to the head 5 through a circular action 8 of ultrasonics, Laser, etc. . . . to obtain the initimate union between 15 and 5, that later on will be reinforced by the injection of the intermediate portion.

On the other hand, the embodiment of FIG. 7 shows within the same figure, two constructive options, in which an auxiliary internal elements 6' is included similar in some ways to that signalled with element 6 in FIG. 3. These options are designated at both sides of shaft 11, with letters A and B, in a way that variant A is related with solution of FIG. 5, and variant B with solution of FIG. 6.

The auxiliary piece 6 is embraced inside the base-wad 5 or 5' as per its position A or B. This auxiliary piece 6 can be plastic fabricated or made from any other material, it can be of the form indicated in FIGS. 3 and 7 or any other, as for example, a metallic strip with a central inflexion as a promontory 9.

As per the application of the type of shot that the cartridge has to make, there will be adopted one or the other of the previously mentioned solutions, modifying the quality of the materials of which the promontory is constituted, or even combining adequate and opportunely all these variations between themselves.

Therefore, the basic idea is that the fulminant is fully enclosed in the internal part of the cartridge, fully closed to the outside, constituting a block free from any type of external attacks or contamination by dampness, aging, etc. etc.

It will be obvious to those skilled in the art that various changes may be made without departing from the scope of the invention and the invention is not to be considered limited to what is shown in the drawings and described in the specification.

What is claimed is:

1. A cartridge case assembly of the type constituted by internal wad, external extruded tube and intermediate body or welding mass characterized in that the wad is formed with a hollow cylindrical chamber or cavity at the head side of the case, a longitudinal shaft portion disposed therein with a promontory extending therefrom to a peak in the direction toward the cartridge head, fulminate resting on said peak, all secured together by the intermediate welding mass, said intermediate welding mass fusion-welding the case with the wad, embracing the latter in such a way that the fulminate is included within it, forming an integrating monobloc of case, wad and fulminat, so that appropriate weight means and communication means with the containers chamber of the gun-powder adjacent to wad are included within the space of the fulminate housing.

2. A cartridge case assembly as defined in claim 1 wherein the promontory is constitutive of the inner piece or wad.

3. A cartridge case assembly as defined in claim 1 wherein the promontory is composed of a piece housed and centered within the wad cylindrical chamber.

4. A cartridge case assembly as defined in claim 1 wherein the fulminate is disposed on the lower base of the promontory.

5. A cartridge case assembly as defined in claim 1 wherein a circular cover is provided at the external base on the front of the case that supports in one of its surfaces the fulminate, said cover being connected to the internal wad by means of a circular application or ultrasonics, prior to the further injection of the welding mass.

* * * * *